US009102443B2

(12) United States Patent
Fisher et al.

(10) Patent No.: US 9,102,443 B2
(45) Date of Patent: Aug. 11, 2015

(54) FLEXIBLE PACKAGES INCORPORATING A TWISTABLE POLYMER RECLOSE MATERIAL

(75) Inventors: Thad J. Fisher, DeForest, WI (US); Charles W. Halgren, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 323 days.

(21) Appl. No.: 13/436,706

(22) Filed: Mar. 30, 2012

(65) Prior Publication Data

US 2013/0259406 A1 Oct. 3, 2013

(51) Int. Cl.

| | |
|---|---|
| ***B65D 33/16*** | (2006.01) |
| ***B65D 33/00*** | (2006.01) |
| ***B65D 65/26*** | (2006.01) |
| ***B65D 33/30*** | (2006.01) |
| ***B65D 77/16*** | (2006.01) |

(52) U.S. Cl.
CPC ..... *B65D 33/30* (2013.01); *B65D 33/165* (2013.01); *B65D 77/16* (2013.01)

(58) Field of Classification Search
CPC ..... B65D 33/30; Y10S 383/905
USPC ..... 383/70, 71, 204, 89, 905
See application file for complete search history.

(56) References Cited

U.S. PATENT DOCUMENTS

| | | | | |
|---|---|---|---|---|
| 651,937 | A * | 6/1900 | Short | 383/70 |
| 892,330 | A * | 6/1908 | Tavis | 383/89 |
| 2,995,174 | A | 8/1961 | Wang | |
| 3,201,030 | A | 8/1965 | Pollack | |
| 3,402,052 | A | 9/1968 | Walker | |
| 3,754,371 | A | 8/1973 | Walker, III | |
| 4,051,994 | A | 10/1977 | Donk et al. | |
| 4,267,768 | A | 5/1981 | Cieslak et al. | |
| 4,797,313 | A | 1/1989 | Stolk et al. | |
| 4,810,103 | A | 3/1989 | Bell | |
| 4,973,171 | A | 11/1990 | Bullard | |

(Continued)

FOREIGN PATENT DOCUMENTS

| | | | |
|---|---|---|---|
| FR | 2267951 | A1 | 11/1975 |
| FR | 2810966 | A1 | 1/2002 |

OTHER PUBLICATIONS

International Search Report, mail dated Jun. 12, 2013 for PCT/US2013/033647 (4 pgs.).

(Continued)

*Primary Examiner* — Jes F Pascua
*Assistant Examiner* — Derek Battisti
(74) *Attorney, Agent, or Firm* — Fitch, Even, Tabin & Flannery LLP

(57) ABSTRACT

A flexible food package comprises a bottom end, a top end, and a side wall incorporating a twistable portion having increased dead fold characteristics than adjacent portions of the side wall. The twistable portion has at least a first section and a second section each having a maximum width and joined by at least a third section having a minimum width less than the maximum width of each of the first and second section. The third section is configured to permit the first and second sections to twist about the third section. The twistable portion is configured to twist together with adjacent portions of the side wall to restrict access to an access opening formed after opening of the top end. A method of manufacturing reclosable flexible packages including twistable portions is also provided.

20 Claims, 8 Drawing Sheets

(56) References Cited

U.S. PATENT DOCUMENTS

| | | | | |
|---|---|---|---|---|
| 5,968,310 | A | 10/1999 | Clark | |
| 7,665,895 | B2 * | 2/2010 | Takita et al. | 383/88 |
| 2004/0013324 | A1 | 1/2004 | Corry | |
| 2004/0223666 | A1 * | 11/2004 | Jenkins | 383/89 |
| 2005/0238262 | A1 * | 10/2005 | Jenkins | 383/89 |
| 2006/0285779 | A1 | 12/2006 | Golas | |
| 2008/0205799 | A1 * | 8/2008 | Sendra | 383/70 |

OTHER PUBLICATIONS

Written Opinion of the International Search Report, mail dated Jun. 12, 2013 for PCT/US2013/033647 (5 pgs.).

* cited by examiner

FLEXIBLE PACKAGES INCORPORATING A TWISTABLE POLYMER RECLOSE MATERIAL

FIELD

The present invention relates to food products packaging, and in particular, to packages incorporating twistable shape-retaining materials for reclosing the packages.

BACKGROUND

Food products such as crackers, cookies, candy, and the like are commonly stored in packages made of polymer materials such as cellophane, polypropylene, or polyethylene. Since a consumer may not eat the food product in the package in one serving, it is desirable for the package to be reclosable to preserve the freshness of the food product and prevent the food product from being accidentally removed from the bag.

Reclosing devices can be provided separately from the packages to facilitate the reclosing of the packages. For example, twist ties can be used to reclose the packages. Clamps or clips can be used to reclose the packages. However, after dispensing the food product from a package, twist ties, clamps, and clips are not always available to a user, and sometimes fall off even when attached to the package.

To avoid the problems associated with aforementioned twist ties and clips, some flexible packages are made with wires or plastic strips incorporating wires being affixed by adhesives or other means to the side walls of the packages. However, affixing metallic materials to the packages during manufacture can increase the cost and complexity of the manufacturing process.

SUMMARY

A flexible food package is provided. The package includes a bottom end, a top end, and a side wall incorporating a twistable portion having increased dead fold characteristics than adjacent portions of the side wall. The twistable portion has at least a first section and a second section each having a maximum width and joined by at least a third section having a minimum width less than the maximum width of each of the first and second sections. The third section is configured to permit the first and second sections to twist about the third section. The twistable portion is configured to twist together with adjacent portions of the side wall to restrict access to an access opening formed after opening of the top end.

The twistable portion can be provided in a multitude of different shapes. For instance, The twistable portion can have a generally hour glass shape with enlarged top and bottom portions relative to a narrowed portion therebetween. The twistable portion can have an upper edge and a lower edge opposite the upper edge that are parallel to each other, non-parallel to each other, or a first portion of the upper and lower edges can be parallel to the lower edge and a second portion of the upper edge can be non-parallel to the lower edge.

The twistable portion can be provided on an interior surface or on an exterior surface of the side wall. The twistable portion can be attached by an adhesive to the side wall or can be integrally formed from the side wall.

The package can include at least a fourth section having a maximum width greater than the minimum width of the third section. The fourth section can be joined to the second section by a fifth section having a minimum width less than the maximum width of either one of the second and fourth sections. The package can have one or more score lines extending between an upper edge of the twistable portion and the top end of the package for separating the top end from the package.

A method of using the aforementioned package is also provided. The method includes removing the top end of the package to form the opening. The method also includes removing a food product stored in the package through the opening. The method also includes twisting the twistable portion together with adjacent portions of the side wall to restrict access to the opening. The method can further include twisting the twistable portion in an opposite direction to reopen the package and provide access to the food product through the opening.

A method of manufacturing the aforementioned package is also provided. The method includes providing a continuous film of packaging material. The method also includes applying to the film a twistable material having increased dead fold characteristics than the film. The method also includes sealing portions of the film to form the top and bottom ends of the package and enclose the food product. The method can further include applying a twistable material to a surface of the film corresponding to an interior surface of the package. The method can further include applying a twistable material to a surface of the film corresponding to an exterior surface of the package.

A flexible food storage package in another form is provided. The package includes a side wall having a closed bottom end and a closed top end separable from the package along at least one score line and including a twistable portion having increased dead fold characteristics than the side wall. The twistable portion is configured to twist about itself and around a cinched portion of the side wall to restrict access to an opening formed after removal of the top end and twistable portion. The twistable portion is configured to be partially separated from the package.

A flexible food package in another form is provided. The package includes a side wall having a bottom end and a removable top end. The side wall incorporates a Y-shaped twistable portion having higher dead fold characteristics than adjacent portions of the side wall. The twistable portion includes a leg extending toward the bottom end of the package and a pair of arms extending toward the top end of the package. The arms are configured to twist together and be maintained in an interlocking manner with adjacent portions of the side wall to reclose an opening formed after removal of the top end. The leg can be straight and each of the arms can be at least in part curved.

DETAILED DESCRIPTION

A flexible reclosable food package for storing food products has a side wall incorporating material having greater dead fold characteristics than adjacent portions of the side wall. The material forms a twistable portion that provides the package with a reclose feature. In particular, after a user opens the package and removes a desired portion of the food product, the user can twist the twistable portion together with the side wall of the package to form a twisted configuration to reclose the package. The twistable portion can hold the package open and maintain the package closed when desired.

Figure 1:
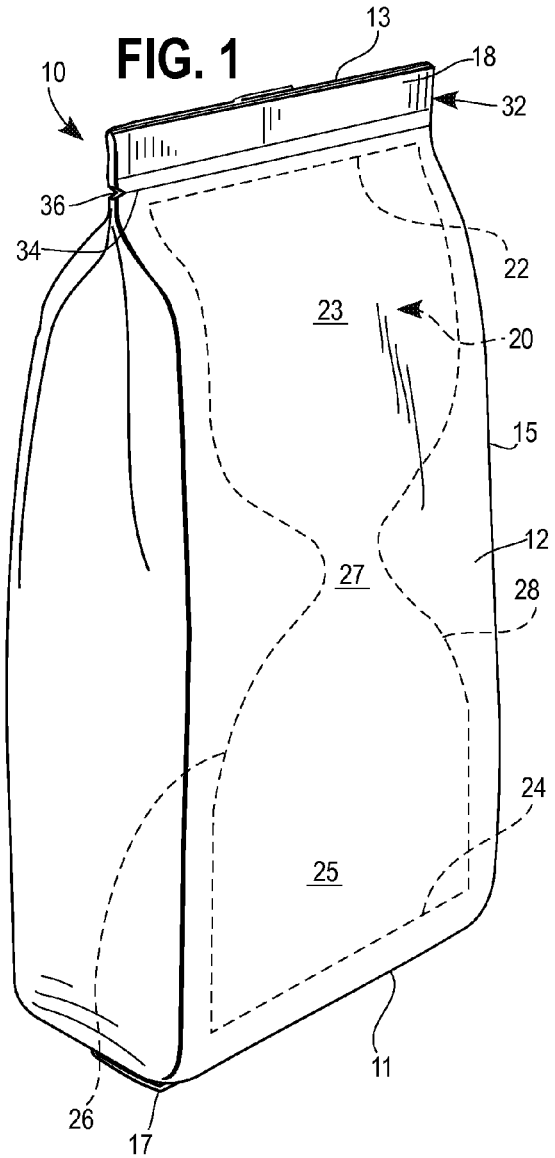
FIG. 1 is a perspective view of an exemplary flexible package incorporating a polymer reclose material.
Figure 2:
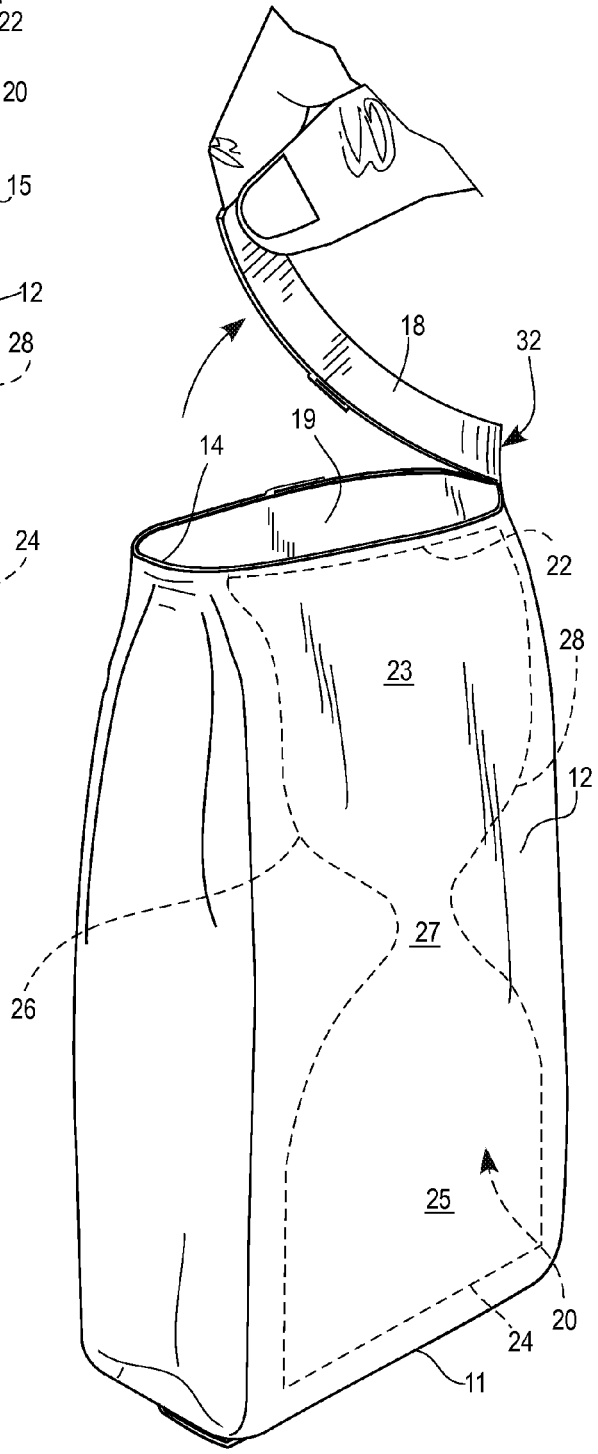
FIG. 2 is an perspective view of the package of FIG. 1 shown with a removable portion being separated to open the package.
Figure 3:
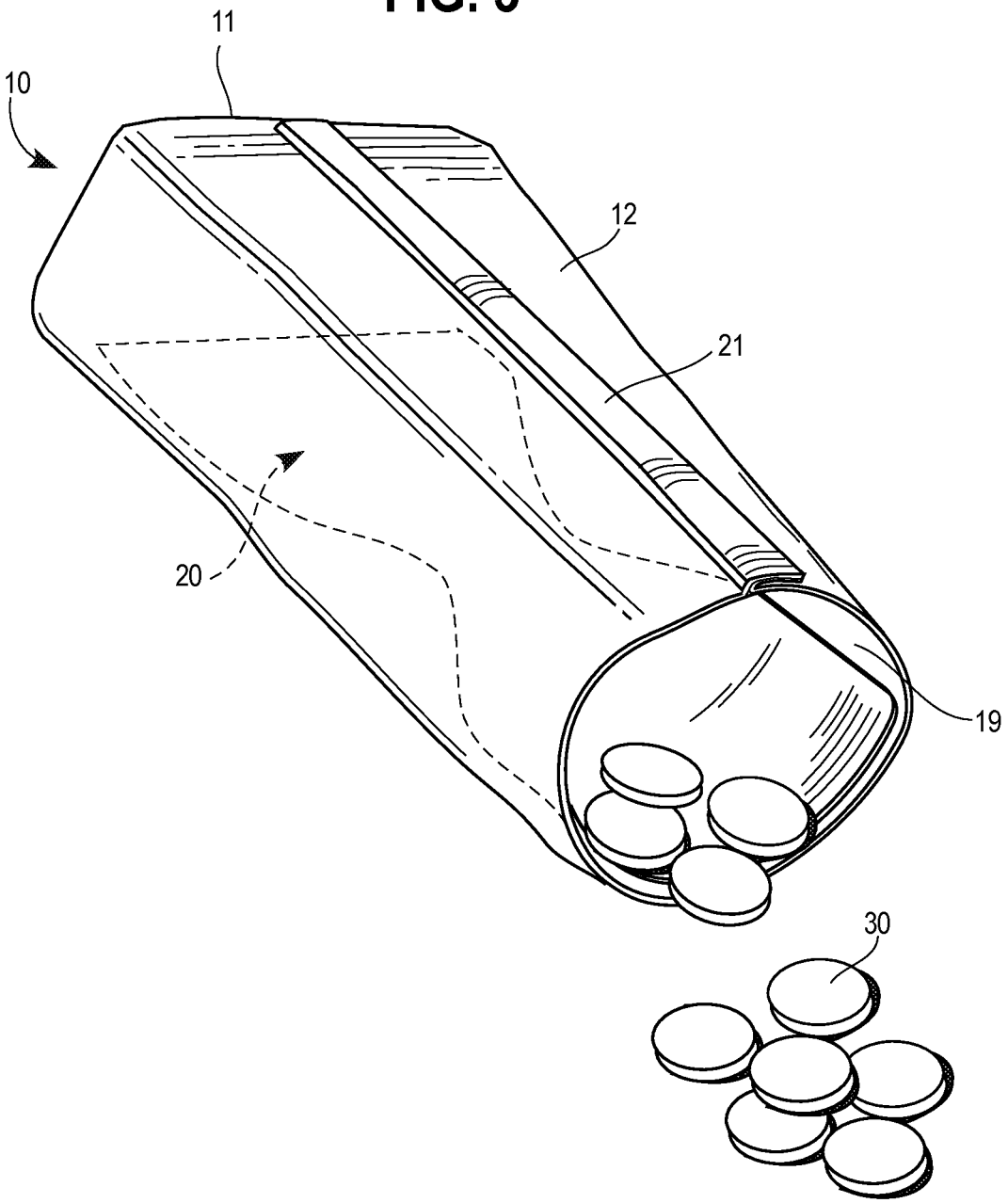
FIG. 3. is a perspective view of the package of FIG. 1 being open and dispensing the food product.

With reference to FIGS. 1-3, an exemplary flexible reclosable food package 10 is provided. The package 10 is in the form of a bag and includes a side wall 12, a bottom end 11, and a top end 13. A longitudinal axis passes through the bottom and top ends 11 and 13 of the package 10.

The side wall 12 of the package 10 has an interior surface 14 and an exterior surface 15. The interior surface 14 surrounds an interior 16 where the food product 30 is stored. The food product 30 may include crackers, cookies, wafers, chocolates, candy, cheese bits, nuts, grains, or the like. A gusset can optionally be provided at the bottom end 11 of the package. It will be appreciated that while a gusseted package has been illustrated, the package 10 may have other shapes and may lack a gusset.

With reference to FIG. 1, the side wall 12 of the package 10 incorporates a twistable portion 20 that provides the package 10 with a reclose feature. The twistable portion 20 has higher dead fold characteristics and is more rigid than adjacent portions of the side wall 12 of the package 10. The twistable portion 20 has an upper edge 22, a lower edge 24, a first side 26, and a second side 28 opposite the first side 26. The twistable portion 20 is in the shape of an hourglass with bulb-like first and second sections 23 and 25 being joined by a neck-like waisted third section 27 with arcuate curves therebetween. The first and second sections 23 and 25 can have substantially identical widths and each have a greater width than the third section 27. While the twistable portion 20 has been shown in FIG. 1 as having an hourglass shape, the twistable portion 20 may be formed in a variety of different shapes.

Referring to FIGS. 1-3, the package 10 can include a top seal 18 at the top end 13 of the package 10. The bottom end 11 of the package 10 can have a bottom seal 17. The package 10 can also include a fin seal 21 extending between the bottom end 11 and the top end 13, as shown in FIG. 3. Any of the above-described seals may be made by conventional methods, including, for example, the application of heat and pressure to create a laminate seal.

The side wall 12 of the package 10 includes a removable portion 32, which includes the top seal 18. The top end 13 of the package 10 can be opened to reveal an access opening 19. Opening the top end 13 will be understood to mean either separating the removable portion 32 (in whole or part) and the top seal 18 from the rest of the package 10 to reveal the opening 19, or pulling the top end 13 and the top seal 18 apart to reveal the opening 19 without separating the top end 13 and the top seal 18 from the package 10, or otherwise forming an access opening in the package 10 for removal of the food product. The removable portion 32 may be separated from the remainder of the package 10 along one or more score lines 34 formed in the side wall 12 to form the access opening 19 as shown in FIG. 2. The removable portion 32 provides a tamper-evident feature such that the absence of, or damage in, the removable portion 32 could indicate that the package 10 has been previously open and/or damaged.

With reference to FIG. 2, when the package 10 is open, the twistable portion 20 can provide structural support to the side wall 12 and restrict the portion of the side wall 12 that forms the mouth of the opening 19 from collapsing inward. The twistable portion 20 also can retain the opening 19 in a suitable accessible configuration, for example, a circular, oval, or C-shape, and permits the user to easily dispense the food product 30 from the package 10, as shown in FIG. 3. The opening 19 can be sized to permit multiple items of the food product 30 to be dispensed from the package 10 simultaneously. For example, if the package 10 were to store small circular crackers or cookies, the diameter of the opening 19 could be greater than three times the diameter of each cracker or cookie.

Figure 4:
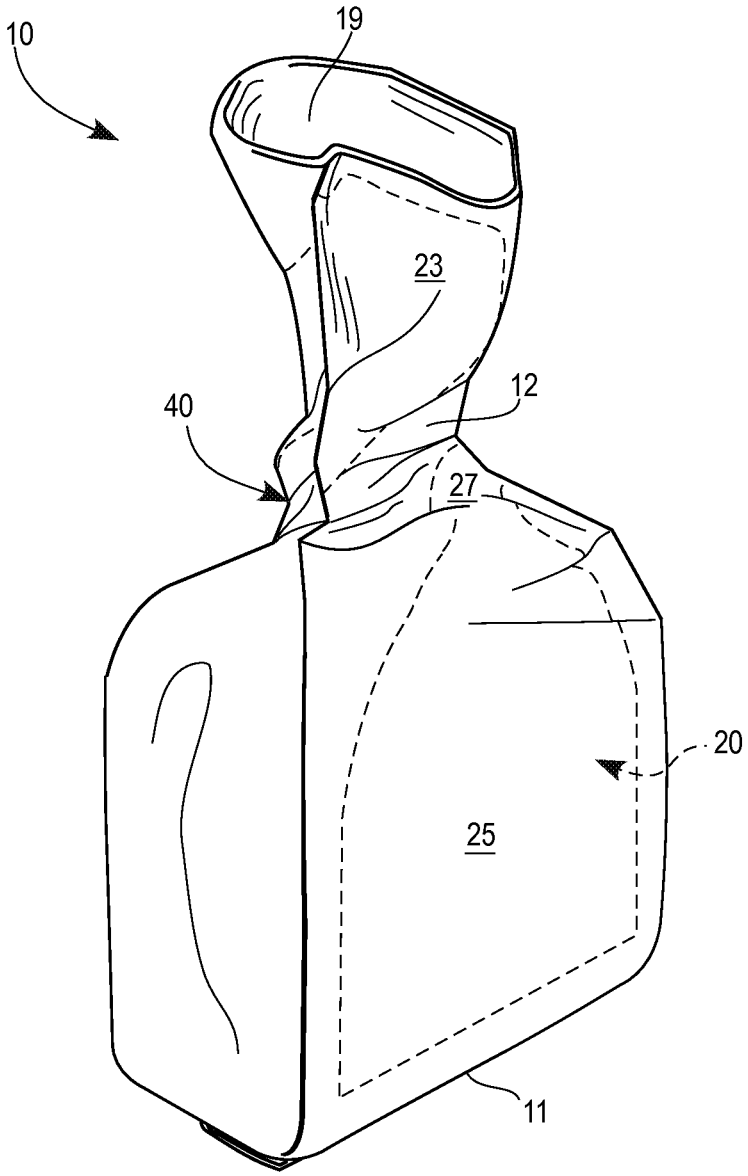
FIG. 4 is a perspective view of the package of FIG. 1, shown with the reclose material being twisted to maintain the package in a reclosed configuration.

After a user dispenses some of the food product 30 from the package 10, the user can reclose the package 10 by rotating the twistable portion 20 in a clockwise or counterclockwise direction about the longitudinal axis. During the rotation of the twistable portion 20, the neck-like third section 27, which is less resistant to twisting than adjacent first and second sections 23 and 25, tends to twist such that the first section 23 pivots relative to the second section 25, as shown in FIG. 4. Thus, the second section 27 can act as a pivot region between the first section 23 and the second section 25. Since the twistable portion 20 is incorporated in the side wall 12 of the package 10, the rotation of the twistable portion 20 causes adjacent portions of the flexible side wall 12 to twist and form a twisted configuration 40 that restricts access to the food product through the opening 19 of the package 10, as shown in FIG. 4.

After the twistable portion 20 is rotated to twist the side wall 12 of the package 10 as shown in FIG. 4, the twistable portion 20 can retain its shape to keep the package 10 closed until a user subsequently reopens the package 10. The twistable portion 20 can retain its shape because the material from which it is made has relatively higher dead fold characteristics than the material forming portions of the side wall 12 adjacent the twistable material 20.

If the package 10 did not include the twistable portion 20 and the side wall 12 were twisted to the position shown in FIG. 4, the package 10 would likely open because the side wall 12 would tend to untwist due to its relatively low dead fold characteristics. The increased rigidity and higher dead fold characteristics of the twistable portion 20 relative to the adjacent portions of the side wall 12 permit the twistable portion 20 to not only retain its own shape when twisted, but to restrict the side wall 12 from untwisting as well. It is to be appreciated that the rigidity of the twistable portion 20 or any other portion of the side wall 12 of the package 10 may be increased via selective curing by UV light or another suitable method.

To reopen the package 10 after it has been reclosed, the user can counter-rotate the twistable portion 20 such that the first section 23 and third section 27 return to their original position shown in FIG. 1, and the twisted configuration 40 of the side wall 12 untwists to again permit access to the opening 19. After the user removes an additional portion of the food product 30 from the package 10, the food product 30 remaining in the package 10 can be again reclosed by rotating the twistable portion 20 as discussed above.

A score line will be understood to be any line of weakness formed in the side wall 12 of the package 10. The score lines 34 in the side wall 12 can be formed by ablation with a laser, but may be formed by other suitable techniques, for example, die-cutting or micro-abrasion. While the score lines 34 have been shown as being formed in the exterior surface 15 of the package 10, the score lines 34 may be alternatively formed in the interior surface 14 of the package 10. Moreover, while the score lines 34 have been shown as being straight, the score lines 34 may be curved (e.g., convex, concave, undulating, etc.).

The package 10 may further include a tear notch 36. The tear notch 36 may be formed by a laser cut through a portion of the package 10, or may be formed using other techniques, for example, a die cut. The notch 36 provides a tear initiation site that facilitates the separation of the removable portion 32 and the top seal 18 from the package 10 along the score lines 34. It will be appreciated that the notch 36 can be formed in the side wall 12 between the top seal 18 and the twistable portion 20 as shown in FIG. 1, or may be formed in the top seal 18 (not shown).

In order to open the package 10, a user can grasp the package 10 near the notch 36 and tear the side wall 12 of the package 10 in a direction shown in FIG. 2. The tear leads through the side wall 12 and follows along the score lines 34, separating the removable portion 32 and the top seal 18 from the side wall 12 of the package 10 to provide the user with access to the food product 30 through the access opening 19, as shown in FIG. 2.

The upper edge 22 of the twistable material 20 can be parallel and positioned in close proximity to the score lines 34, as shown in FIG. 1. The twistable material 20 is more rigid than adjacent portions of the side wall 12 and its close proximity to the score lines 34 can reduce tear deviation and facilitate a predictable and consistent path for the separation of the removable portion 32 along the score lines 34. It will be appreciated that while the score lines 34 and the upper edge 22 of the twistable material 20 have been shown as being horizontal (i.e., perpendicular to the longitudinal axis of the package 10), both the score lines 34 and the upper edge 22 of the twistable material 20 may be oriented at a variety of angles to the longitudinal axis.

Figure 5:
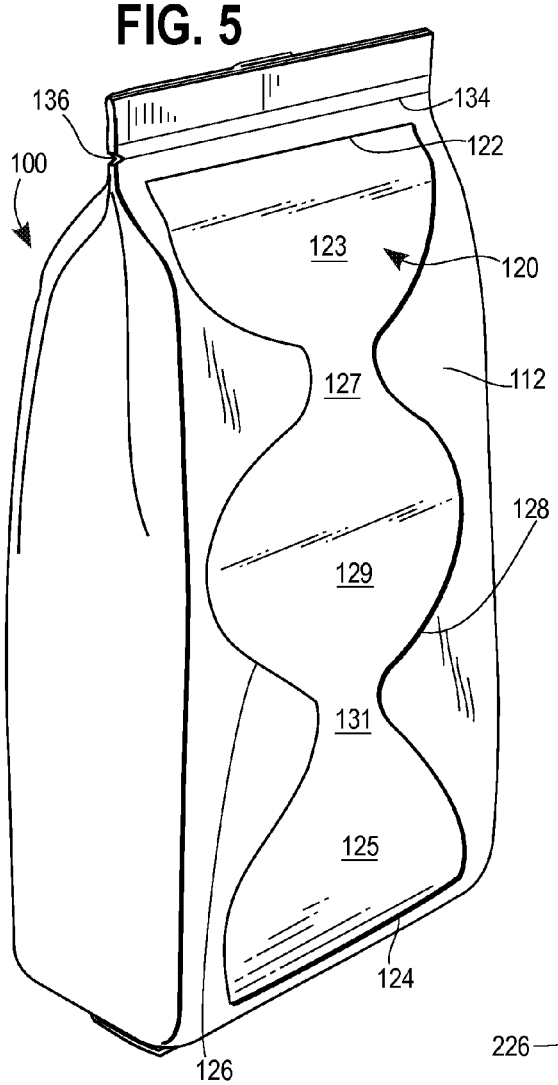
FIG. 5 is a perspective view of another exemplary flexible package incorporating a polymer reclose material having multiple waisted regions.

FIG. 5 illustrates another exemplary reclosable flexible package 100. The package 100 is similar to the package 10 except that while the twistable portion 20 of the package 10 is in the shape of the hourglass, the twistable portion 120 is in the shape of a double hourglass. The twistable portion 120 has an upper edge 122, a lower edge 124, a first side 126, and a second side 128 opposite the first side 126.

With reference to FIG. 5, the twistable portion 120 has three bulb-like sections 123, 125, and 129. Sections 123 and 129 are joined by one neck-like section 127. Sections 129 and 125 are joined by another neck-like section 131. As shown in FIG. 5, the bulb-like sections 123, 125, and 129 can have substantially identical widths, and the neck-like sections 127 and 131 also can have substantially identical widths. Each of sections 123, 125, and 129 has a greater width than each of sections 125 and 131.

After initiating a tear in the package 100 proximate the notch 136 and propagating the tear along the score lines 134 to separate the removable portion 132 and open the package 100, the user can dispense a desired portion of the food product through the opening of the package 100 and then reclose the package 100. Depending on the amount of the food product dispensed from the package 100, the user can reclose the opening by rotating the twistable portion 120 around the longitudinal axis of the package 100 such that section 127 twists and section 123 turns relative section 129; and/or rotating the twistable portion 120 about the longitudinal axis such that section 131 twists and section 129 turns relative to section 125. This twisting and turning results in the twisting of a portion of the side wall 112 and the formation of a twisted configuration similar to the twisted configuration 40 that restricts access to the opening of the package 100 substantially in the same way as shown in FIG. 4.

It is to be appreciated that a maximum height of the package 100 in the reclosed position depends on the amount of the food product 30 dispensed by the user. For example, if a user dispenses approximately one third of the food product from the package 100 and rotates the twistable portion 120 such that only one neck-like section 127 twists to reclose the package 100, the height of the package 100 would be decreased by approximately one third relative to the untwisted package 100 of FIG. 5. Similarly, if the user dispenses approximately two thirds of the food product from the package 100 and rotates the twistable portion 120 such that both of the neck-like sections 127 and 131 twist to reclose the package 100, the height of the package 100 would be decreased by approximately two thirds relative to the untwisted package 100.

Figure 6:
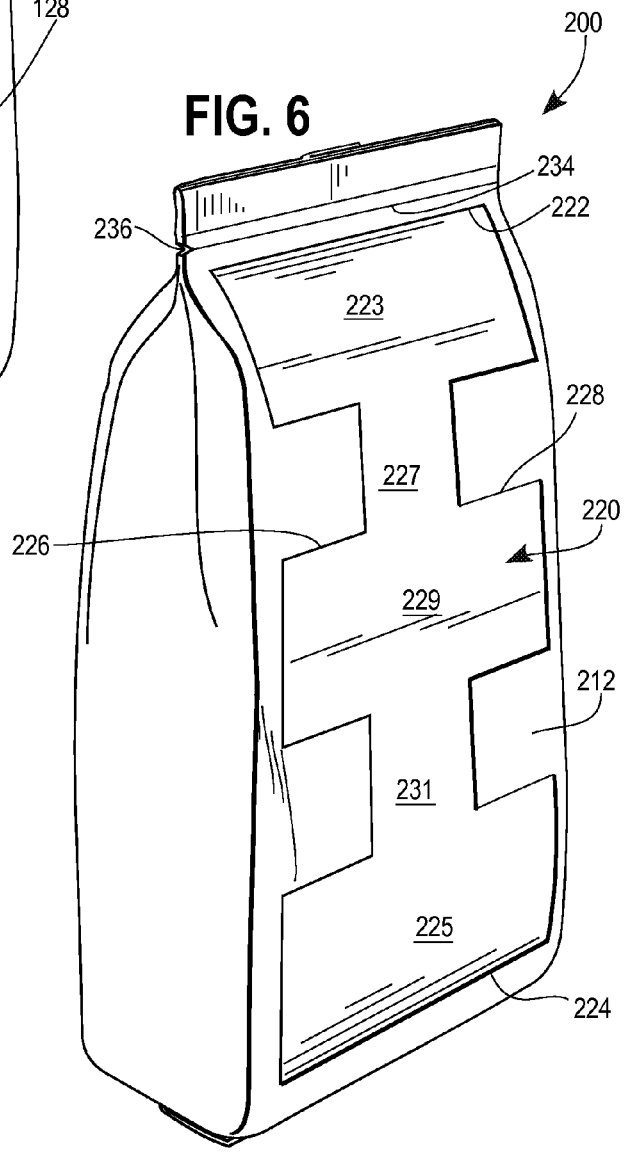
FIG. 6 is a perspective view of another exemplary flexible package incorporating a polymer reclose material having rectangular narrowed regions.

FIG. 6 shows another exemplary reclosable flexible package 200. The package 200 is similar to the package 100 of FIG. 5 in that the twistable portion 220 in the side wall 212 also includes three wide sections 223, 225, and 229 having substantially identical widths and two reduced width sections 227 and 231 that join section 223 with 229 and section 229 with 225, respectively. Also, the first and second sides 226 and 228 of the twistable portion 220 are not curved like the sides 126 and 128 of the twistable portion 120 discussed above with reference to FIG. 5. Instead, the first and second sides 226 and 228 comprise linear segments that extend from the top edge 222 to the bottom edge 224 of the twistable portion 220 such that the twistable portion 220 includes multiple rectangular regions having increased width being separated by rectangular narrowed regions. After being opened along the notch 236 and the score lines 234 to dispense some of the food product, the package 200 can be reclosed in a way similar to the package 100 by rotating the twistable portion 220 to twist one or both of the reduced width sections 227 and 231.

Figure 7:
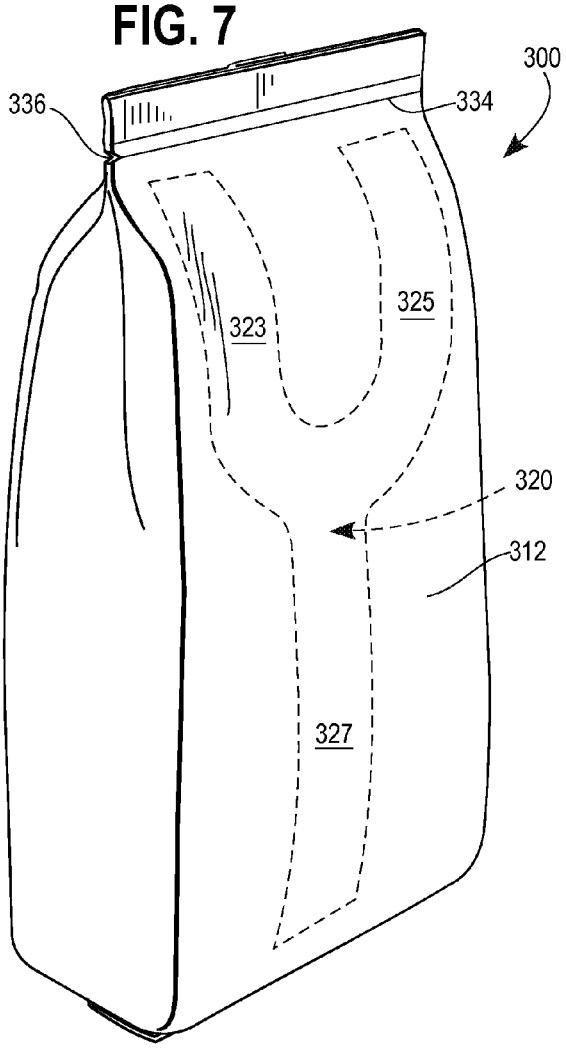
FIG. 7 is a perspective view of yet another exemplary flexible package incorporating a polymer reclose material having a Y-shape.

FIG. 7 shows another exemplary reclosable flexible package 300. The package 300 is similar to the package 10 of FIGS. 1-3, but unlike the hourglass-shaped twistable portion 20 of the package 10, the twistable portion 320 of the package 300 is Y-shaped. The twistable portion 320 has first and second sections 323 and 325 joined by a third section 327.

Figure 8:
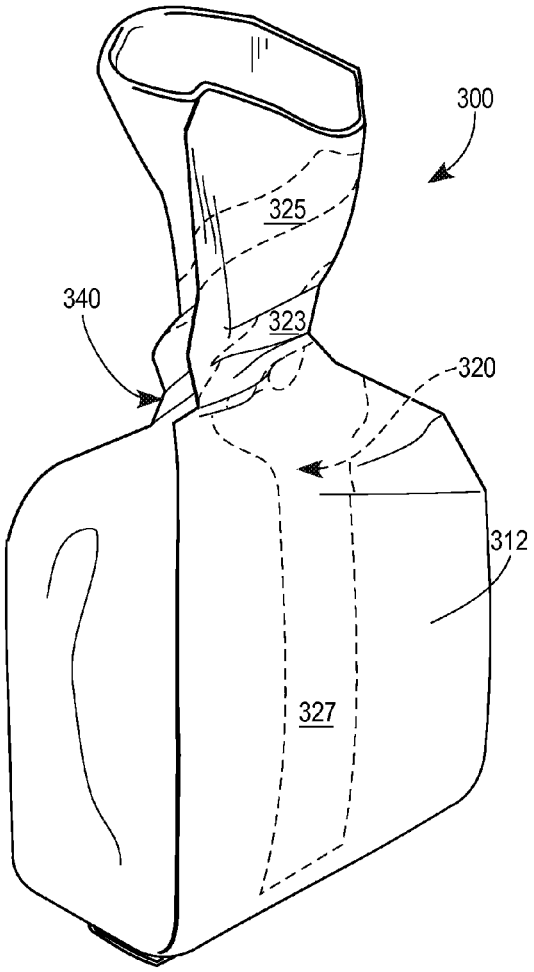
FIG. 8 is a perspective view of the package of FIG. 7, shown with the reclose material being twisted to maintain the package in a reclosed configuration.

After the user opens the package 300 along the notch 336 and the score lines 334 and dispenses a desired portion of the food product, the user can reclose the package 300 by rotating the twistable portion 320 about the longitudinal axis of the package 300. Upon rotation of the twistable portion 320, the first and second sections 323 and 325 twist and interlock with each other to form a twisted configuration 340, as shown in FIG. 8. Since the twistable portion 320 has relatively higher rigidity and dead fold characteristics than the rest of the side wall 312 of the package 300, the first and second sections 323 and 325 tend to retain their twisted configuration such that the package 300 remains reclosed.

Depending on the amount of the food product dispensed from the package 300 by the user, the first and second sections 323 and 325 of the twistable portion 320 can be rotated by an appropriate number of full revolutions to reclose the package 300 and reduce the maximum height of the package 300. For example, the twistable portion 320 may be rotated by one quarter revolution, by one half revolution, from one half to one full revolution, from one to two full revolutions, from two to three full revolutions, or more full revolutions about the longitudinal axis.

Figure 9:
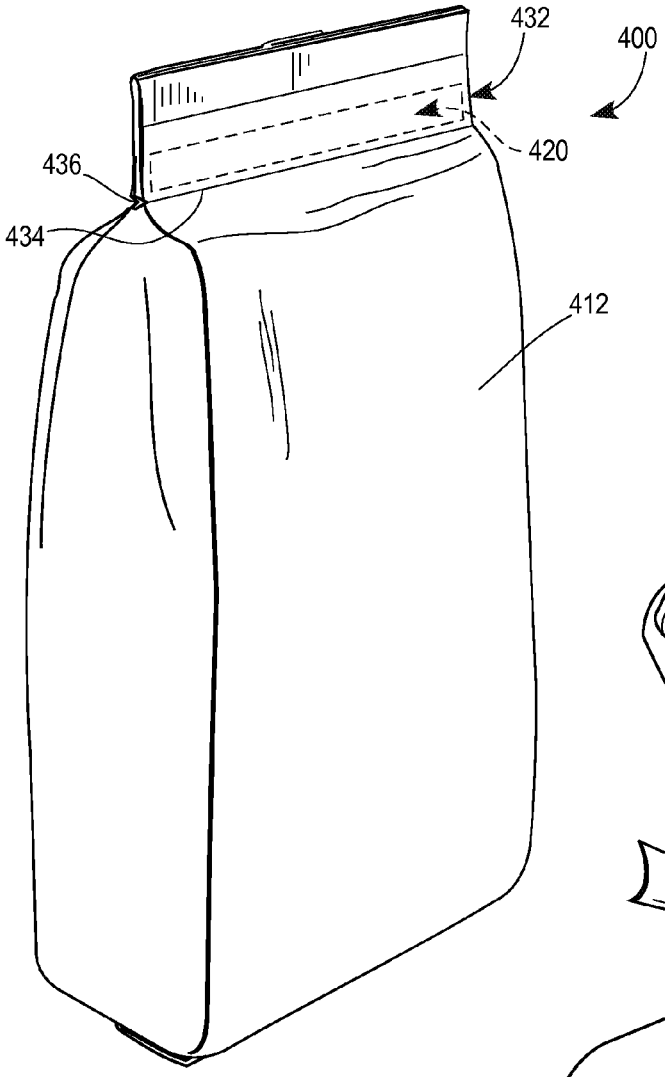
FIG. 9 is a perspective view of another exemplary flexible package incorporating a polymer reclose material disposed in a removable header seal.

FIG. 9 shows another exemplary reclosable package 400 that includes a header seal. In contrast to the packages 10, 100, 200, and 300, the twistable portion 420 of the package 400 is in the form of a strip. The twistable portion 420 can extend across a portion or the entire width of the package 400. The twistable portion 420 can be made of the same material as the twistable portions 20, 120, 220, and 320.

Figure 10:
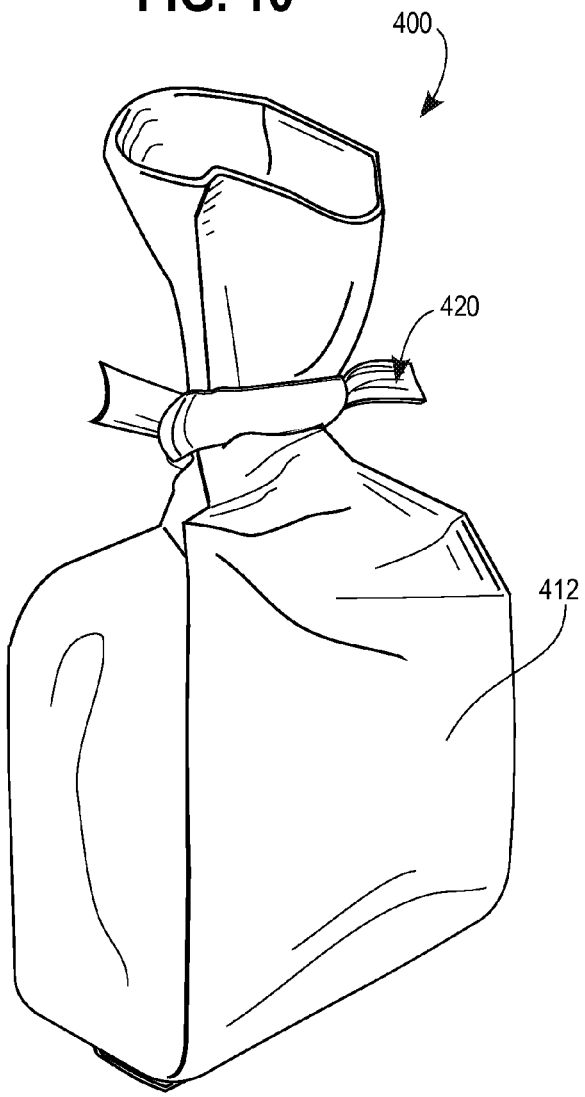
FIG. 10 is a perspective view of the package of FIG. 9, shown with the side wall being held in a reclosed configuration using the polymer reclose material.

Another distinction between the package 400 and the packages 10, 100, 200, and 300 is that the score lines 434 that permit the removable portion 432 to be separated from the package 400 are below, not above, the twistable portion 420. After the removable portion 432 is separated either in part (as shown in FIG. 2) or in its entirety along the score lines 434 from the rest of the package 400, the twistable portion 420 can be twisted around the side wall 412 of the package 400 to reclose the opening as shown in FIG. 10. It will be appreciated that the removable portion 432 can be twisted around the side wall 412 to reclose the package 400 optionally while being less than fully separated from the side wall 412 of the package 400. The partial attachment of the twistable portion 420 and the side wall 412 decreases the possibility that the twistable portion 420 could become detached from the package 400 and lost.

Figure 11:
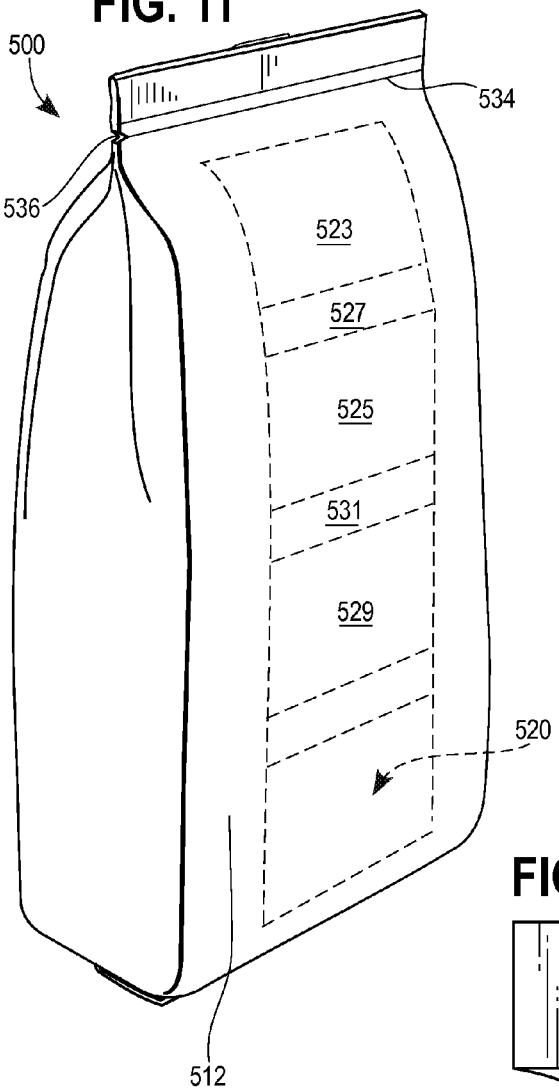
FIG. 11 is a perspective view of another exemplary flexible package incorporating a polymer reclose material having spaced zones with increased shape retention properties.

FIG. 11 shows another exemplary reclosable package 500. The side wall 512 of the package 500 includes a twistable portion 520 in the form of a longitudinal strip. In contrast to the twistable portion 420 of FIG. 9, which extends in a direction transverse to the longitudinal axis of the package 400, the twistable portion 520 extends in a direction along the longitudinal axis of the package 500. The length of the twistable portion 520 may be less than one half of the maximum height of the package 500, more than one half of the maximum height of the package 500 (as shown in FIG. 11), or can be equal to the maximum height of the package 500, among other heights. The twistable portion 520 may also have a width that is less than or greater than one half of the width of the package 500. The structure of the strip 520 is shown in more detail in FIG. 12.

Figure 12:
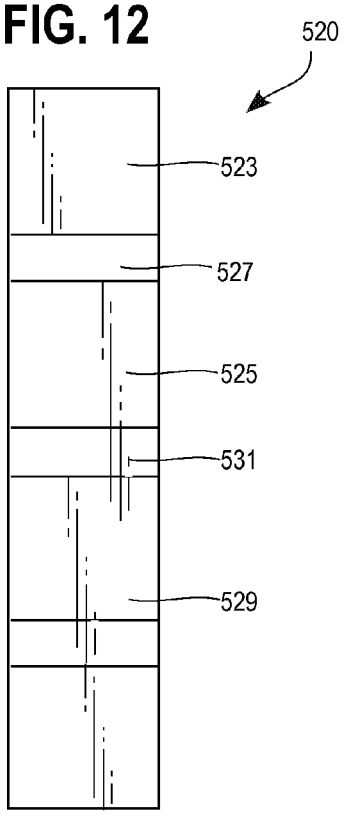
FIG. 12 is an enlarged fragmentary view of the polymer reclose material of the package shown in FIG. 11.

With reference to FIG. 12, the twistable portion 520 includes alternating larger (e.g., 523, 525, and 529) and smaller (e.g., 527 and 531) sections. Larger sections 523, 525, and 529 have higher rigidity and dead fold characteristics than smaller sections 527 and sections 531. Each of sections 523, 525, 527, 529, and 531 of the twistable portion 520 is more rigid and has higher dead fold characteristics than adjacent portions of the side wall 512 of the package 500. While larger sections 523, 525, and 529 and smaller sections 527 and 531 have been illustrated as being rectangular, they could have any other suitable shape.

Figure 13:
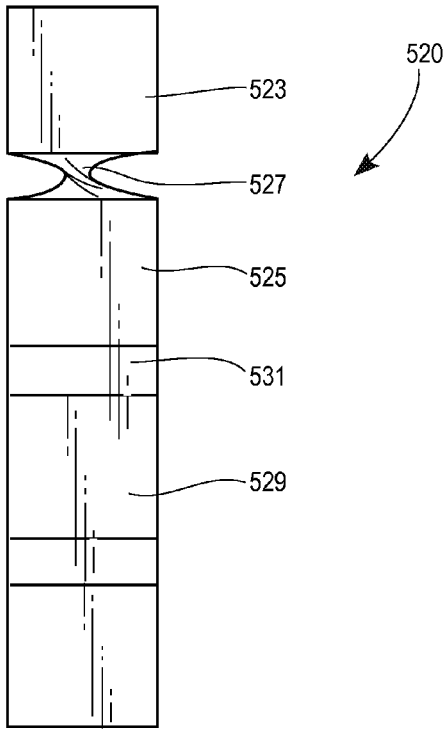
FIG. 13 is the same view as in FIG. 12, but shown with one section of the polymer reclose material twisted.

To reclose the package 500 after opening the package 500 along the notch 536 and the score lines 534 and dispensing a desired portion of the food product 30, the user can rotate the twistable portion 520 about the longitudinal axis of the package 500. During the rotation of the twistable portion 520, section 527, which is less rigid and has less resistance to being twisted than surrounding sections 523 and 525, twists and provides a pivot point for section 523 to turn relative to section 525, as shown in FIG. 13. If the user were to further rotate the twistable portion 520, section 531 would twist and provide a pivot point for section 529 to turn relative to section 525 (not shown). As more and more of the food product is dispensed by the user from the package 500, the user can reclose the package 500 by rotating the twistable portion 520 by more and more revolutions and twisting additional sections 527 and 531 (not shown) to sequentially reduce the total height of the package 500.

Figure 14:
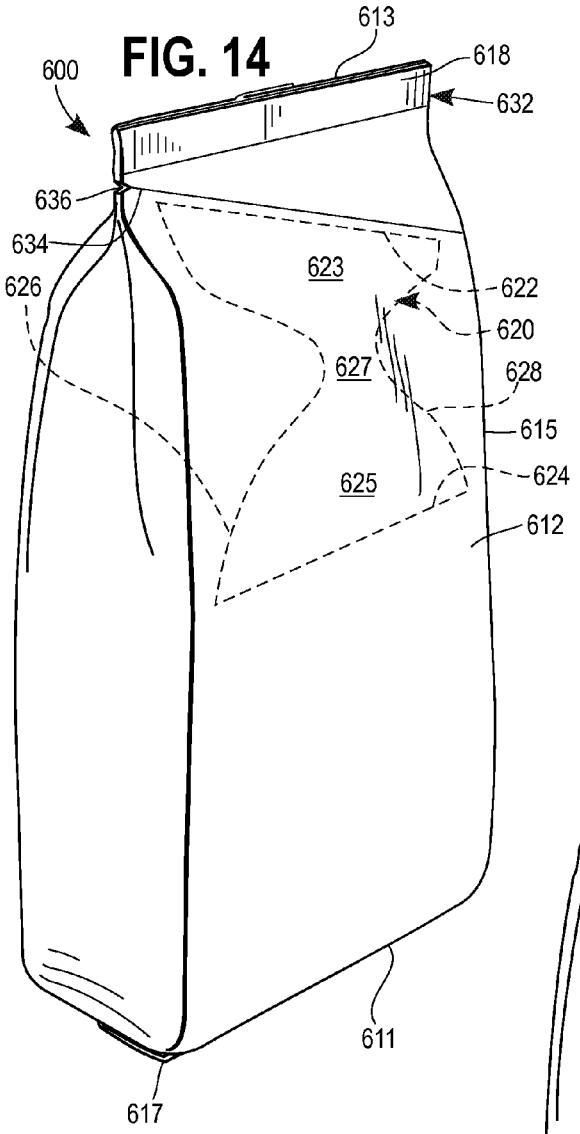
FIG. 14 is a perspective view of another exemplary flexible package incorporating a polymer reclose material having an upper edge that slopes downward.
Figure 15:
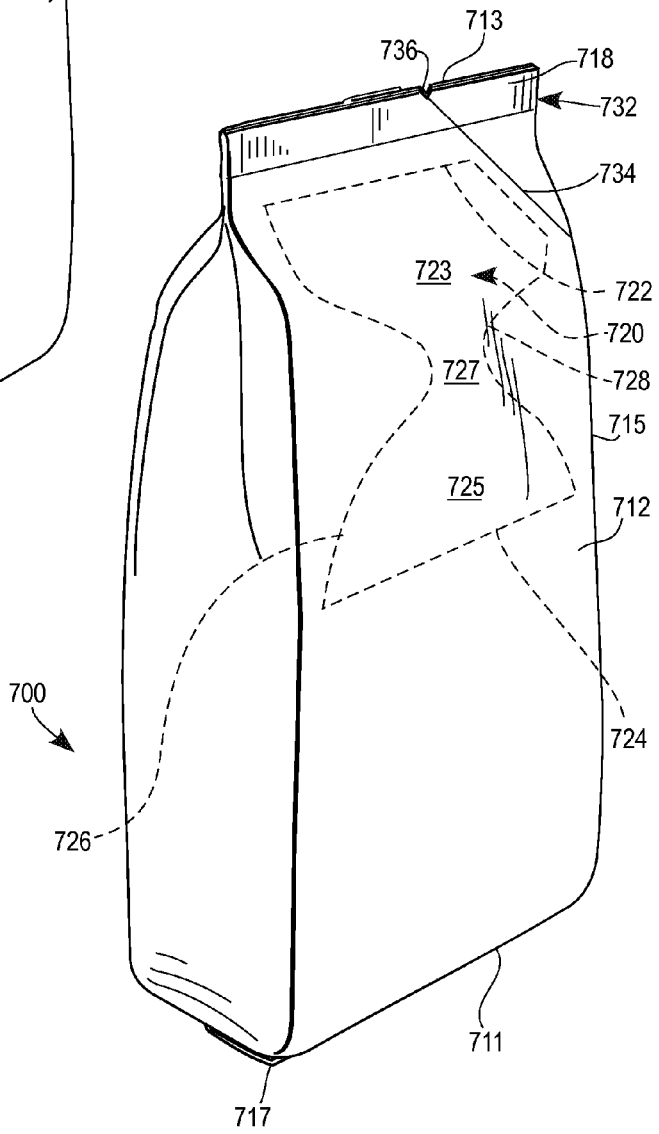
FIG. 15 is a perspective view of another exemplary flexible package incorporating a polymer reclose material having an upper edge that is partly slopes downward.

With reference to FIGS. 14 and 15, alternative exemplary flexible reclosable food packages 600 and 700 are provided. The packages 600 and 700 are similar to the package 10 in that the twistable portions 620 and 720 of the packages 600 and 700 are in the shape of an hourglass like the twistable portion 20 of the package 10. The twistable portions 620 and 720 have approximately the same width across the packages 600 and 700 as the width of the twistable portion 20 across the package 10.

The height of each twistable portion 620 and 720, defined as the distance between their upper and lower edges 622 and 624 and 722 and 724, respectively, is approximately one half of the height of the twistable portion 20, defined as the distance between its upper and lower edges 22 and 24. Thus, the twistable portions 620 and 720 have a height that is less than one half of the height of the packages 600 and 700 as measured from their top ends 613 and 713 to their bottom ends 611 and 711, respectively. It is to be appreciated that the packages 10, 100, 200, 300, and 500 could be modified to have a twistable portion 20, 120, 220, 320, and 520, respectively, having approximately the same height as the twistable portions 620 and 720 such that the height of the twistable portions 10, 120, 220, 320, and 520 would be less than one half the height of the packages 10, 100, 200, 300, and 500, respectively.

With reference to FIG. 14, the twistable portion 620 is in the shape of an hourglass with relatively wider, bulb-like first and second sections 623 and 625 being joined by a narrowed, neck-like waisted third section 627 with arcuate curves therebetween. The twistable portion 620 also has an upper edge 622, a lower edge 624, a first side 626, and a second side 628 opposite the first side 626.

Unlike the upper and lower edges 22 and 24 of the twistable portion 20, the upper and lower edges 622 and 624 of the twistable portion 620 are not parallel to each other. Instead, the upper edge 622 extends downwardly from its intersection with the first side 626 to its intersection with the second side 628. The score line 634 can be parallel to the upper edge 622 of the twistable portion 620 and extends downwardly from the tear notch 636 across the width of the package 600.

This configuration results in the package 600 having a larger removable portion 632 than the removable portion 32 of the package 10. As such, when a user desires to dispense the food product from the package 600 and grasps and separates the removable portion 632 from the rest of the package 600 along the score lines 634, a larger portion of the package 600 is removed as compared to when the removable portion 32 of the package 10 is removed. After a user dispenses some of the food product from the package 600, the user can reclose the package 600 by rotating the twistable portion 620 in a clockwise or counterclockwise direction about the longitudinal axis as described above in reference to FIG. 4.

With reference to FIG. 15, the twistable portion 720 is in the shape of an hourglass with bulb-like first and second sections 723 and 725 being joined by a neck-like waisted third section 727 with arcuate curves therebetween. The twistable portion 720 has an upper edge 722, a lower edge 724, a first side 726, and a second side 728 opposite the first side 726.

Unlike the upper edge 622, which extends in its entirety downwardly from its intersection with the first side 626 to its intersection with the second side 628, the upper edge 722 is in part parallel to the lower edge 724 and in part angled downwardly toward the second side 728. As shown in FIG. 15, the part of the upper edge 722 that is parallel to the lower edge 724 extends across a majority of the width of the package 700. The score line 734 can be parallel to the upper edge 722 of the twistable portion 720 and extends downwardly from the tear notch 736 formed in the top end 713 of the package 700.

This configuration results in the twistable portion 720 being shaped like an hourglass with a missing corner as shown in FIG. 15. As such, when a user grasps and separates the removable portion 732 from the rest of the package 700 along the score lines 734, a corner of the package 700 is removed to permit the user to dispense the food product from the package 700. After a user dispenses some of the food product from the package 700, the user can reclose the package 700 by rotating the twistable portion 720 in a clockwise or counterclockwise direction about the longitudinal axis as described above in reference to FIG. 4.

With reference to FIGS. 14 and 15, the upper edges 622 and 722 of the twistable portions 620 and 720 are parallel and positioned in close proximity to the score lines 634 and 734, respectively. This allows the twistable portions 620 and 720, which are more rigid than adjacent portions of the side walls 612 and 712, respectively, to reduce tear deviation and facilitate a predictable and consistent path for the separation of the removable portions 632 and 732 along the score lines 634 and 734, respectively.

It will be appreciated that while the score lines 634 and 734 and the upper edges 622 and 722 of the twistable portions 620 and 720 have been shown as at least in part parallel to one another and sloping downward, the score lines 634 and 734 and the upper edges 622 and 722 may be non-parallel and may slope upward. Furthermore, while the upper edges 622 and 722 have been illustrated as being linear, the may instead be partially or entirely curved or undulating.

It will be appreciated that while the twistable portions 20, 320, 420, 520, 620, and 720 have been shown in the drawings as being incorporated on the interior surfaces of the side walls of the packages 10, 300, 400, 500, 600, and 700, respectively, the twistable portions 20, 320, 420, 520, 620, and 720 may be alternatively incorporated on the exterior surfaces of the side walls of the packages 10, 300, 400, 500, 600, and 700, similar to the twistable portions 120 and 220, which have been shown as being formed on the exterior surfaces of the packages 100 and 200. In particular, as the flexible film that will serve as a side wall of a package moves in a direction along the forming tube during manufacture, one or more materials can be applied in the machine direction to either an interior surface or an exterior surface of the film to form the twistable portions shown in FIGS. 1-15. Applying the twistable material to the flexible film may include, but is not limited to attaching by adhesives, bonding, or fusing the twistable material to the film.

It is to be appreciated that the twistable portions of any of the above-discussed packages may also be formed from the side walls of the packages. For example, as the flexible film moves in the machine direction, predetermined portions of the film may be cured by UV light or other methods to form one or more regions having higher rigidity and higher dead fold characteristics than adjacent portions of the film. Such regions of higher dead fold characteristics could be in the shape of a single hourglass (FIGS. 1, 14, and 15), a double hourglass (FIG. 5), a Y (FIG. 7), a strip (FIG. 11), or other suitable shapes, and can become twistable portions 20, 620, 720, 220, 420, and 520, respectively.

It is further to be appreciated that while the above-discussed packages have been shown as having the twistable portion on one side of the package, the twistable portion may be formed on each of the opposite sides of the package. In addition, it is to be appreciated that the scores lines in the above packages may extend across the entire width of the package, or may extend only across a portion of the width.

It is further to be appreciated that while the above-discussed packages have been described as being reclosed by a twisting of the twistable portions about the longitudinal axis of the package, the packages may also be reclosed by folding the top end of the package in a direction toward the bottom end. Due to the higher dead fold characteristics of the twistable portions as compared to the rest of the side walls of the packages, the twistable portion, once folded, will tend to stay folded such that the package remains reclosed.

The above-discussed packages may be made from a polymeric, flexible film. The flexible film may be made from various materials, including, but not limited to, polyethylene, polypropylene, polyester, and the like. The flexible film may also be laminated and optionally include a metalized layer. The packages can have a height of about 100 millimeters to 1000 millimeters and a width of about 30 millimeters to about 300 millimeters. The twistable portions can be formed from a material such as high density polyethylene (HDPE), low density polyethylene (LDPE), polylactide (PLA), cyclin olefin copolymer (COC), or the like. The twistable portions may be laminated or co-extruded to form multi layer structures. In addition, the twistable portions can include blended cellulose fibers. The twistable portions can have a thickness from about 1-10 millimeters, and preferably, from about 2 millimeters to about 4 millimeters.

An advantage of the reclosable packages is that they can made entirely from the same material in one manufacturing step. Another advantage of the above-discussed reclosable packages is that the twistable portion can be made from a non-metallic material to reduce the total cost of the package. Yet another advantage is that the twistable portion provides the side wall with increased dead fold characteristics and can both hold the package open and maintain the package closed when desired. Still another advantage is that the portion of the side wall including the twistable portion is provided with increased rigidity and tensile strength.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the concept.

The invention claimed is:

1. A flexible food package comprising a bottom end, a top end, and a side wall incorporating a solid sheet twistable portion having increased dead fold characteristics than adjacent portions of the side wall, the twistable portion having at least a first section and a second section each having a maximum width parallel to the top end and joined by at least a third section having a minimum width parallel to the top end and less than the maximum width of each of the first and second sections, the first and second sections of the twistable portions each being formed of same material across their respective maximum widths, the third section being configured to permit the first and second sections to twist about the third section, the twistable portion being configured to twist together with adjacent portions of the side wall to restrict access to an access opening formed after opening of the top end.

2. The package of claim 1, wherein the twistable portion has an hour glass shape.

3. The package of claim 1, further comprising at least a fourth section having a maximum width greater than the minimum width of the third section, the fourth section being joined to the second section by a fifth section having a minimum width less than the maximum width of either one of the second and fourth sections.

4. The package of claim 1, further comprising one or more score lines extending between an upper edge of the twistable portion and the top end of the package for separating the top end from the package.

5. The package of claim 1, wherein the twistable portion is provided on an interior surface of the side wall.

6. The package of claim 1, wherein the twistable portion is provided on an exterior surface of the side wall.

7. The package of claim 1, wherein the twistable portion is attached by an adhesive to the side wall.

8. The package of claim 1, wherein the twistable portion is integrally formed from the side wall.

9. The package of claim 1, wherein the twistable portion comprises an upper edge and a lower edge opposite the upper edge, the upper and lower edges being parallel to each other.

10. The package of claim 1, wherein the twistable portion comprises an upper edge and a lower edge opposite the upper edge, the upper and lower edges being non-parallel to each other.

11. The package of claim 1, wherein the twistable portion comprises an upper edge and a lower edge opposite the upper edge, a first portion of the upper and lower edges being parallel to the lower edge and a second portion of the upper edge being non-parallel to the lower edge.

12. A method of using the package of claim 1, the method comprising:

removing the top end of the package to form the opening;

removing a food product stored in the package through the opening; and twisting the twistable portion together with adjacent portions of the side wall to restrict access to the opening.

13. The method of claim 12, further comprising twisting the twistable portion in an opposite direction to reopen the package and provide access to the food product through the opening.

14. A method of manufacturing the package of claim 1, the method comprising:

providing a continuous film of packaging material;

applying a twistable material having increased dead fold characteristics than the film to the film; and sealing portions of the film to form the top and bottom ends of the package and enclose the food product.

15. The method of claim 14, wherein the applying a twistable material includes applying a twistable material to a surface of the film corresponding to an interior surface of the package.

16. The method of claim 14, wherein the applying a twistable material includes applying a twistable material to a surface of the film corresponding to an exterior surface of the package.

17. A flexible food package comprising a side wall formed from at least one material and having a bottom end and a removable top end, the side wall incorporating a Y-shaped twistable portion having higher dead fold characteristics than adjacent portions of the side wall, the twistable portion being formed by curing a portion of the side wall, the twistable portion including a leg extending toward the bottom end of the package and a pair of arms extending toward the top end of the package, the arms being configured to twist together and be maintained in an interlocking manner with adjacent portions of the side wall to reclose an opening formed after removal of the top end.

18. The package of claim 17, wherein the leg is straight and each of the arms is at least in part curved.

19. The package of claim 1, wherein the first and second sections of the twistable portions each extend continuously across a majority of a width of the package.

20. The package of claim 1, wherein the side wall is formed from at least one material and wherein the first and second sections of the twistable portions are formed from a cured material integrally formed in the side wall from the at least one material.

* * * * *